United States Patent [19]

Hard et al.

[11] Patent Number: 4,595,413

[45] Date of Patent: Jun. 17, 1986

[54] GROUP IVB TRANSITION METAL BASED METAL AND PROCESSES FOR THE PRODUCTION THEREOF

[75] Inventors: Robert A. Hard, Oley, Pa.; Joseph A. Megy, Corvallis, Oreg.

[73] Assignee: Occidental Research Corporation, Los Angeles, Calif.

[21] Appl. No.: 626,672

[22] Filed: Jul. 2, 1984

Related U.S. Application Data

[63] Continuation-in-part of Ser. No. 439,801, Nov. 8, 1982, Pat. No. 4,470,847.

[51] Int. Cl.[4] ..... B22F 9/00

[52] U.S. Cl. ..... 75/0.5 BB; 75/251

[58] Field of Search ..... 75/0.5 BB, 251, 84.4, 75/84.5

[56] References Cited

U.S. PATENT DOCUMENTS

| | | | |
|---|---|---|---|
| 3,119,685 | 1/1964 | Hansley et al. | 75/0.5 BB |
| 4,356,029 | 10/1982 | Down et al. | 75/0.5 BB |
| 4,390,365 | 6/1983 | Hard et al. | 75/84.4 |
| 4,445,931 | 5/1984 | Worthington | 75/84.4 |
| 4,470,847 | 9/1984 | Hard et al. | 75/84.4 |
| 4,477,277 | 10/1984 | D'Altilia | 75/84.4 |

*Primary Examiner*—Wayland Stallard

*Attorney, Agent, or Firm*—Christie, Parker & Hale

[57] ABSTRACT

Passified Group IVb transition metal-based metal particles having a controlled particle size distribution suitable for metallurgy usage without additional particle size reduction and process for making the same. Such metal particles are substantially free of halides, hydrogen, oxygen, nitrogen and carbon and are produced at temperatures considerably below that of arc melting temperatures of Group IVb transition metals and alloys based thereon.

70 Claims, 6 Drawing Figures

GROUP IVB TRANSITION METAL BASED METAL AND PROCESSES FOR THE PRODUCTION THEREOF

This patent application is a continuation-in-part application of U.S. patent application Ser. No. 439,801 filed Nov. 8, 1982, now U.S. Pat. No. 4,470,847, on PROCESS FOR MAKING TITANIUM, ZIRCONIUM AND HAFNIUM-BASED METAL PARTICLES FOR POWDER METALLURGY which is incorporated by reference.

CROSS-REFERENCE TO RELATED PATENT APPLICATIONS

This patent application is related to U.S. Ser. No. 216,058 filed Dec. 22, 1980, now U.S. Pat. No. 4,390,365, and titled "Process for Making Titanium Metal from Titanium Ore".

BACKGROUND OF THE INVENTION

Group IVb transition metals, specifically titanium, zirconium and hafnium, are essential to the aerospace, nuclear, and the chemical processing industries. The high strength and excellent resistance to chemical attack of metals having titanium, zirconium and hafnium as a base are the principal reasons for their demand. Demand for Group IVb metals has outstripped production capabilities in some countries.

Titanium is a strong, light metal that is useful at many temperatures, malleable when heated and ductile when pure. It is used in the pure state or in alloys for aircraft and chemical industry, for surgical instruments, and in cermets, and metal-ceramic braising. Zirconium is a hard metal that is strong and ductile and is used in the nuclear industry and in alloys, pyrotechnics, welding fluxes and explosives. Hafnium, although not as widely used because of its relative expense, is used primarily in the nuclear and chemical process industries. For many uses, alloys which are based on the Group IVb metals have better properties and wider usage than the pure metals themselves.

Impurities outside specification values in the Group IVb metals and alloys based on the Group IVb metals can cause such metals and alloys based thereon to be brittle and hence, of little use. Impurities such as halides, carbon, oxygen, nitrogen and silicon can cause the Group IVb metals and alloys based thereon to be greatly reduced in strength and chemical resistance. Small amounts of silicon and oxygen can be used in Group IVb transition metal alloys, such as hafnium and zirconium alloys.

The Group IVb metals and alloys based thereon are also useful in powder metallurgy for the production of articles which would be more expensive or more difficult to produce by machining or forging from massive metal shapes. This invention is directed toward the production of Group IVb metal powders and alloy powders based on Group IVb metals. Articles made by powder metallurgy from such powders can be ground, milled, drilled and welded.

SUMMARY OF THE INVENTION

This invention relates to the passified Group IVb transition metal-based particles, and alloys based thereon, which are substantially free of halides, and which are suitable for powder metallurgy usage without further particle size reduction, and processes for the production thereof. By particles as used herein, is meant to include powders and granules as well as particles.

A very important advantage of this invention is the capability of producing metal shapes, i.e., near net shapes, directly from a metal sponge without the necessity of an expensive arc melting step which is required in conventional technology for consolidation or alloying of the Group IVb transition metals.

In one embodiment of this invention, which comprises hydriding, such passified Group IVb transition metal-based metal particles are produced by heating a Group IVb transition metal-zinc alloy which is substantially free of halides, at a temperature between about 500° and about 1150° C. under conditions which are operative to vaporize and separate the zinc from such alloy and to produce a Group IVb transition metal sponge or metal based sponge thereon which is substantially free of both zinc and halides. Conventional metal sponges have an internal porosity of between about 15% to about 25% by volume. The metal sponges of the present invention have internal porosities of between about 10% to about 30% by volume. By substantially free of zinc herein is meant less than 0.1% by weight. By substantially free of halides herein is meant less than 0.02%. In some embodiments of this invention, no more than about 100 parts per million by weight (PPM) of zinc and about 50 PPM of halides are contained in the Group IVb transition metal-zinc alloy. Preferably the Group IVb metal or alloy thereof has less than about 10 PPM metal halide.

In an alternative embodiment of the present invention which does not require hydriding and dehydriding, the Group IVb transition metal-zinc alloy can be comminuted to or formed into particles and the zinc distilled off as described herein to produce Group IVb transition metal powder. The transition metal-zinc alloy is brittle. Preferably, the transition metal-zinc alloy contains no alloying agents which toughen the alloy and render the alloy difficult to comminute. The Group IVb transition metal-zinc alloy can be formed into small particles by conventional means known to the art, such as shot tower processing in a nondeleteriously reactive atmosphere, such as a helium or argon atmosphere.

Group IVb transition metals prepared by conventional processes, such as the Hunter process or Kroll process for titanium, contain halide salts, such as sodium chloride or magnesium chloride. With conventional processes, it is difficult to produce Group IVb transition metals having halide contents of less than 2000 PPM. Halides form fine small holes in Group IVb transition metals which act as crack initiators and make the metal laible to fatigue cracking. In addition, it is very difficult to obtain good welds on Group IVb transition metals having a halide content of more than 50 PPM. As a consequence of the halide contamination of Group IVb metals prepared by conventional methods, Group IVb metals used in high technology applications, such as aircraft and submarine applications or nuclear applications must be subject to ingot metallurgy to reduce the halide content to at least 50 PPM. The metal is conventionally melted twice using arc metallurgy. Arc metallurgy processes are capital intensive and energy intensive.

By Group IVb transition metal-zinc alloy herein is meant a titanium-zinc alloy or zirconium-zinc or hafnium-zinc alloy. Thusly, produced transition metal or metal based thereon is heated to, or maintained at, a temperature between about 850° and about 1250° C., preferably between about 1020° and about 1060° C., under conditions which are operative to sinter the transition metal. Sintering is necessary in order to reduce the surface area of the Group IVb transition metal-based metal particles and thus reduce the amount of oxygen or nitrogen required for subsequent passification of the transition metal, or alloy based thereon, so that it may be readily and safely stored and used for powder metallurgy at a later time.

During sintering, the particles of Group IVb transition metal-based metal shrink in size by about 50 to about 85% but in general retain their original shape. Such sintered particles are not fused together although usually there is some sticking or adhering of the particles to each other. Such adhered particles can be readily separated by mechanical means.

The particles of sintered transition metal values are cooled to a lower temperature between about 300° and 700° C. during which time they are simultaneously contacted with hydrogen or a gaseous stream containing hydrogen under conditions which are operative to hydride and embrittle the sintered transition metal values. By transition metal values herein is meant either a Group IVb transition metal or a Group IVb transition metal-based metal. The hydrided and embrittled transition metal values can now be readily comminuted to a predetermined particle size distribution. The hydriding and subsequent embrittlement greatly facilitates controlling the comminution of the Group IVb transition metal values. The improved controllability afforded by the hydriding of the Group IVb transition metal values is a particularly important aspect of this invention because it ultimately enables the production of a passified Group IVb transition metal-based metal particles of a size distribution readily adaptable and operable for powder metallurgy usage.

Such hydrided and embrittled transition metal-based metal particles are comminuted under a nondeleteriously-reactive atmosphere, to a predetermined particle size distribution. The comminuted transition metal values are treated at a temperature between about 400° and about 700° C., preferably between about 600° and about 700° C. under conditions operative to remove essentially all hydrogen values from the comminuted transition metal values and to produce Group IVb transition metal-based metal particles. By the expression "removing essentially all hydrogen values from the comminuted transition metal values" is meant that the transition metal values contain no more than about 200 PPM of hydrogen.

The dehydrided Group IVb transition metal-based metal particles are then contacted with a small or effective amount of a gas selected from the group consisting of oxygen, nitrogen and mixtures thereof, under conditions operative to passify the transition metal particles thereby producing passified transition metal particles. The controlled comminuting of the hydrided and embrittled transition metal values is such that the passified transition metal-based metal particles ultimately produced have at least a substantial amount by weight of such transition metal-based metal particles which are suitable for powder metallurgy usage without further particle size reduction. As used herein, a substantial amount is meant at least about 50% by weight of the passified transition metal-based metal particles produced. In one embodiment of this invention, at least about 95% by weight of the particles produced are suitable for powder metallurgy use without further particle size reduction. Generally, particles no greater than about ¼ inch, preferably from +200 to −30 mesh (U.S. Sieve Series), are suitable for powder metallurgy usage without further particle size reduction. It is to be noted that this embodiment of this invention is particularly useful where extremely fine powder metallurgical particles are required or where a yield of suitable powder is required, or where a highly tailored particle size distribution is required which is not easily or economically obtainable by other means.

In another embodiment of this invention, the heating of the Group IVb transition metal-zinc alloy to vaporize zinc therefrom, and the subsequent sintering of the transition metal values produced thereby is conducted in the same zone or vessel. In a further embodiment, the hydriding and embrittlement of the sintered transition metal values are also conducted in the same zone or vessel as the zinc vaporization and sintering steps.

In another further embodiment of this invention, the nondeleteriously-reactive atmosphere used during the comminuting of the embrittled transition metal values and/or sintering of the Group IVb transition metal values is an inert gas, such as argon or helium. In another embodiment, the nondeleteriously-reactive atmosphere used during the comminuting step is hydrogen.

In still another further embodiment of this invention the heating or distillation of the Group IVb transition metal-zinc alloy to vaporize and separate zinc therefrom, is conducted under a partial vacuum. In a second embodiment of this invention, such heating is conducted under a continuous flow of a nondeleteriously-reactive sweep gas. In a further embodiment, the sweep gas is selected from the Group consisting of hydrogen, inert gas (such as, argon or helium), and mixtures thereof.

In one further embodiment of this invention, the dehydriding and/or sintering of the particles of transition metal values is conducted under a partial vacuum.

Another embodiment of this invention, which does not necessarily require hydriding to produce passified Group IVb transition metal-based metal particles which are substantially free of halides, and which are suitable for powder metallurgy usage, from a Group IVb transition metal-zinc alloy, comprises forming a Group IVb transition metal-zinc alloy which is substantially free of halides, into particles having a particle size distribution of about 90% by weight between about 80 mesh and about ¼ inch. Then, heating such particles in a zone maintained at a temperature between about 500° and 1150° C., and simultaneously introducing into the zone a continuous flow of a nondeleteriously-reactive sweep gas. The zone is maintained under conditions operative to vaporize and separate zinc from the transition metal-zinc alloy particles and thereby produce particles of Group IVb transition metal values which are substantially free of zinc and halides. Such transition metal values will comprise essentially the pure Group IVb transition metal or such metal with minor amounts of other metals desirable in the ultimate final product, that is, alloys thereof. For example, such other metals which may be desirable in the final product and known to those skilled in the art, include but are not limited to aluminum and vanadium. For example, a titanium-based metal alloy may contain, by weight percent, 0 to about 5% tin, 0 to about 10% vanadium, 0 to about 10% aluminum, 0 to about 5% zirconium, 0 to about 5% molybdenum, 0 to about 10% silicon, 0 to about 10% iron, 0 to about 0.5% oxygen and mixtures thereof. A hafnium or zirconium-based metal alloy may contain, by weight percent, 0 to about 3% tin, 0 to about 0.40% iron, 0 to about 0.02% chromium, 0 to about 0.01% nickel, 0 to about 0.5% oxygen and mixtures thereof. A titanium, hafnium or zirconium alloy will normally comprise at least 90% by weight titanium, hafnium or zirconium, respectively; although such alloys can contain less than about 90% by weight titanium, hafnium or zirconium, respectively.

The thusly formed particles which are substantially free of zinc and halides are then heated to, or maintained at, a sintering temperature between about 850° and 1250° C. under conditions operative to sinter such particles. In general, sintering results in a reduction of the surface area of such particles and because of the reduction in surface area, subsequent passification with a passifying gas will require a substantially less amount of such gas and thus reduce the oxygen and/or nitrogen content of the Group IVb transition metal-based metal.

The sintered particles are then cooled to a temperature between about ambient and about 200° C. preferably between about ambient and about 60° C., and then contacted with a small or effective amount of a gas selected from the Group consisting of oxygen, nitrogen, and mixtures thereof, under conditions operative to passify the cooled, sintered particles, thereby producing Group IVb passified transition metal-based metal particles which are substantially free of halides. In all embodiments of this invention, it is essential that the Group IVb passified transition metal-based metal particles be substantially free of halides because halide contamination of the final product can cause voids, loss of strength and fracture toughness, and welding problems.

An important feature of this embodiment of this invention is the forming of a transition metal-zinc alloy of a specified and particular particle size distribution such that the Group IVb transition metal-zinc alloy particles will have a particle size distribution of about 90% by weight between about 80 mesh and about ¼ inch, and the subsequent sintering of such particles at a sintering temperature between about 850° and 1250° C., in combination with the other steps of this process, are operative to cause the passified transition metal-based metal particles ultimately produced to have a particle size distribution such that a significant amount by weight of said passified Group IVb metal-based metal particles are suitable for powder metallurgy usage without additional particle size reduction. By significant amount by weight suitable for powder metallurgy usage without additional particle size reduction as used herein is meant at least about 5% by weight. This embodiment of this invention is, however, capable of producing particles wherein at least about 80% by weight are suitable for powder metallurgy usage without additional particle size reduction.

An advantage of the invention is that the shape or configuration of the feed Group IVb transition metal-zinc alloy particles prior to vaporization of the zinc therefrom, and the subsequent sintering of the particles of Group IVb transition metal values produced from said vaporization of zinc from the metal-zinc alloy, produces particles having about 15 to about 50% of the volume of the feed alloy particles. Thus, it is possible to predetermine the shape of the feed alloy particles and produce pseudomorph particles of the feed alloy particles.

In a further embodiment, the heating or distillation of the particles of transition metal-zinc alloy at a temperature between about 500° and about 1150° C., and the subsequent sintering of the zinc free particles therefrom, are conducted in the same zone or vessel. In a still further embodiment, the cooling and passification of the sintered particles are also conducted in the same zone or vessel as the zinc vaporization and sintering steps.

In still another further embodiment of this invention, the heating or distillation of the Group IVb transition metal-zinc alloy to vaporize and separate zinc therefrom, is conducted under a partial vacuum. In a still further embodiment of this invention, the nondeleteriously-reactive sweep gas used in the heating or distillation of the Group IVb transition metal-zinc alloy is an inert gas. In an alternate embodiment such nondeleteriously-reactive sweep gas is hydrogen. However, where hydrogen is used as the sweep gas, it is necessary to remove all hydrogen values from the final Group IVb transition metal-base particles since hydrogen will cause embrittlement of such particles. Hydrogen can be removed during the dehydriding step described herein.

In a further embodiment of this process, the Group IVb transition metal-zinc alloy particles have a particle size distribution of about 90% by weight between about 60 mesh and about 20 mesh before such particles are heated or distilled at a temperature between about 500 and about 1150° C. to vaporize the zinc therefrom.

In another embodiment of this invention, the forming of a Group IVb transition metal-zinc alloy into such particles is by comminuting of the alloy. In an alternate embodiment such particles are formed by casting the Group IVb transition metal-zinc alloy into particles; preferably, particles of −¼ inch mesh.

The following additional embodiments of this invention are useful whether or not hydriding is employed to facilitate comminution of the transition metal values.

In one embodiment of this process, the Group IVb transition metal-zinc alloy is produced by a process comprising fluorinating a Group IVb transition metal-bearing ore, which comprises Group IVb transition metal oxides, by contacting with an alkali metal fluosilicate at a temperature of from about 600° to about 1000° C. to form a fluorinated ore and to convert the Group IVb transition metal oxides to Group IVb transition metal fluorides; and reducing such fluorides with a zinc reductant metal alloy, such as an aluminum-zinc alloy, to produce the Group IVb transition metal-zinc alloy.

The Group IVb transition metal-zinc alloy can be prepared as shown in the process illustrated in FIG. 1. Alternatively, the alloy may be prepared by adding Group IVb transition metal sponge into a molten batch of zinc agitated to form the Group IVb transition metal-zinc alloy substantially free of halide. If the metal sponge or scrap contains halide, such as sodium halide, the halide salt separates from the metal and metal-zinc alloy when the metal-zinc alloy is formed. The halide salt is immiscible with the metal zinc alloy and floats to the surface of the molten alloy as a separate phase which can be separated from the alloy by conventional means to produce a Group IVb transition metal alloy substantially free of halide. Moreover, a solid zinc metal and a solid Group IVb transition metal may be melted together to form the Group IVb transition metal-zinc alloy substantially free of halide. Halide salts present in the Group IVb transition metal are immiscible with the resulting Group IVb transition metal-zinc alloy and float to the top of the alloy as a separate phase which can be separated from the alloy. When the powder metal end product is to be an alloy of a Group IVb transition metal, the alloying agent may be incorporated into the molten zinc batch prior to introduction of the Group IVb transition metal, or added with the Group IVb transition metal to the molten-zinc batch, or co-melted with the solid zinc metal and the solid Group IVb transition metal.

The Group IVb transition metal-zinc alloy can be prepared from Group IVb transition metal halide salts as set forth in the process illustrated in FIG. 1 by adding the Group IVb transition metal halide salt with zinc and a reductant metal, such as and preferably aluminum, and by melting and agitating the resulting mixture. Optionally, an alkali metal halide salt may be added to the mixture to form a floating phase immiscible with the metal alloy which inhibits the vaporization of the molten zinc. In addition, alloying agents may be added to produce a Group IVb transition metal-zinc-alloy containing the desired alloying agents to yield a Group IVb transition metal based metal alloy product as described herein. The various components may be mixed together and melted as a mix or alternatively the various ingredients may be added to molten zinc or the molten batch of zinc and the reductant metal. Alternatively, the Group IVb transition metal salt may be contacted with the zinc and reductant metal to form the Group IVb transition metal-zinc alloy substantially free of halide and separated from the reaction mixture. Alloy agents may then be added to the molten Group IVb transition metal-zinc alloy to incorporate the desired alloying agents. Such Group IVb transition metal-zinc alloy, with or without additional alloying agents, may be treated as described herein to produce passified Group IVb transition metal-based metal powders suitable for metallurgy usage which are substantially free of halide and zinc.

In one embodiment of this invention, the entire process is conducted at temperatures which are no higher than about 1300° C., and in a preferred embodiment, the entire process is conducted at temperatures which are no higher than about 1200° C., and in an especially preferred embodiment, at a temperature no higher than 1150° C. to prevent sintering of the Group IVb transition metal particles. Thus, the temperatures reached during the conventional high temperature arc melting processes, required for consolidation of, and/or alloying of, for example, titanium products produced by conventional processes, such as, the "Kroll Process", are not required. In other words, the high temperatures required for arc melting are simply not required for this process. Arc melting processes generally require temperatures which exceed the melting point of the particular Group IVb transition metal by about 50° to about 100° C. Such high temperature processes, including those requiring arc melting, require costly equipment which is simply not required by this invention. Thus, a distinct advantage of this invention is the avoidance of very high temperatures required in processes which comprise arc melting.

Some of the advantages of using hydrogen as the sweep gas in the heating or distillation step to vaporize zinc from the Group IVb transition metal-zinc alloy are hydrogen because of its low molecular weight; it facilitates the diffusion of zinc out of the Group IVb transition metal sponge pores and by virtue of such improved diffusion improved heat transfer during the distillation is also realized. In addition, hydrogen is cheaper than helium and argon and other inert gases. Furthermore, although the hydrogen tie bond between hydrogen and the Group IVb transition metal is weak, even the weak hydrogen tie bond will more readily displace zinc as opposed to inert gases where there is no tie bond between the inert gas and the Group IVb transition metal at all. However, if hydrogen is used, substantially all hydrogen values must be removed from the final metal particle product. Hydrogen can be removed from the metal particles by heating the particles to a temperature at from about 600° to about 700° C., preferably under a partial vacuum. By substantially all hydrogen values being removed from the final metal particle product it is meant that no more than about 200 PPM of hydrogen is permitted in the final metal particles produced, and preferably no more than about 50 PPM of hydrogen is in the final product. This is to be compared with conventional process which produce particles having 200 PPM of hydrogen. However, it should be noted that in some embodiments of this invention the process is capable of producing product particles having an even lower PPM of hydrogen than 50 PPM.

It is also desirable and the process is capable of producing such Group IVb transition metal-based metal particles which are substantially free as used herein is meant no more than about 2500 PPM of oxygen, 400 PPM of nitrogen, and 800 PPM of carbon. In some embodiments of this invention, no more than about 800 PPM of oxygen, 90 PPM of nitrogen, and/or 150 PPM of carbon are contained in the product particles of Group IVb transition metal values.

The metal sponge, comprising Group IVb transition metal-based metal, of the present invention is characterized in having less than 50 PPM of halides and an internal porosity of at least 10% by volume. Preferably, the metal has less than about 10 PPM halide and an internal porosity of at least 20% by volume. The powdered metal, comprising Group IVb transition metal-based metal, of the present invention have, besides the same low halide content and high internal porosity as the metal sponge, angular shaped powder particles. Angular shaped powder particles are irregular shaped particles with irregular surface faces on walls and irregular edges. The metal sponge of the present invention is unequaled and no Group IVb transition metal-based metal sponge having the low halide, hydrogen and carbon contamination and high internal porosity described herein has been prepared before. The powder metal of the present invention is unique and no Group IVb transition metal-based metal powder having the low halide, hydrogen, oxygen, nitrogen and carbon contamination and high internal porosity set forth herein and angular shaped powder particles have been prepared before. In fact, it is believed that such metal sponge and powdered metal can only be produced by the process of this invention.

The Group IVb transition metal-based metal powder and sponge of the present invention are superior metals for metallurgical use. The low halide content is essential for maximum metal strength, toughness and durability. The high internal porosity and angular particle shape of the powder permits the fabrication by conventional powder metallurgical processes of strong, durable and defect free shaped Group IVb transition metal-based metal pieces, such as shaped articles, plates, sheets, pipes, rods, beams and billets. The compressibility of the powder and the angular particles of the powder permit the particles to be closely pressed together and securely interlocked when pressed into the desired shapes yielding a cold pressed article with greater green strength than conventional Group IVb transition metal powders for powder metallurgy usage which have higher amounts of contaminants, very little internal porosity and spherical shaped powder particles.

Another advantage of this invention is that the Group IVb transition metal-zinc alloy can contain any desirable additional alloying agents such as aluminum, vanadium or other beneficial elements, which are desirable in the final product particles. Such alloying agents are not required to be added in a high temperature arc melting step. In fact, arc melting is not required in this invention. The alloying agents can be added to the Group IVb transition metal when it is in the form of the Group IVb transition metal-zinc alloy or when such alloy is made. For example, the alloying agent can be added to molten zinc to form a molten zinc alloy. The Group IVb transition metal, such as titanium metal sponge, can be added to the molten zinc alloy to form a Group IVb transition metal-based metal zinc alloy. Alternatively, a Group IVb transition metal halide salt, such as sodium fluotitanate, can be added to the molten zinc alloy when a reductant metal, such as aluminum, is present to reduce the halide salt and produce the Group IVb transition metal-based metal zinc alloy which is recovered by separating it from the floating slag, containing the halide salt of the reductant metal, formed during the reduction of the Group IVb transition metal halide salt. Such alloying agents remain with the Group IVb transition metal as the zinc is vaporized and separated therefrom.

In a preferred embodiment of this invention, the heating or distillation of zinc from the alloy is conducted at a temperature between about 900° and about 950° C., sintering is conducted between about 1020° and about 1060° C., embrittlement and hydriding is conducted between about 600° and about 700° C., and passification is conducted at about ambient to about 60° C.

It will be appreciated that a particular advantage of this process is the avoidance of entrapment of halide salts in the passified transition metal-based metal particle product. Another advantage is that heating or distillation to vaporize and separate zinc and sintering may be conducted in the same zone, reactor, or vessel.

DESCRIPTION OF THE PREFERRED EMBODIMENT

Figure 1:
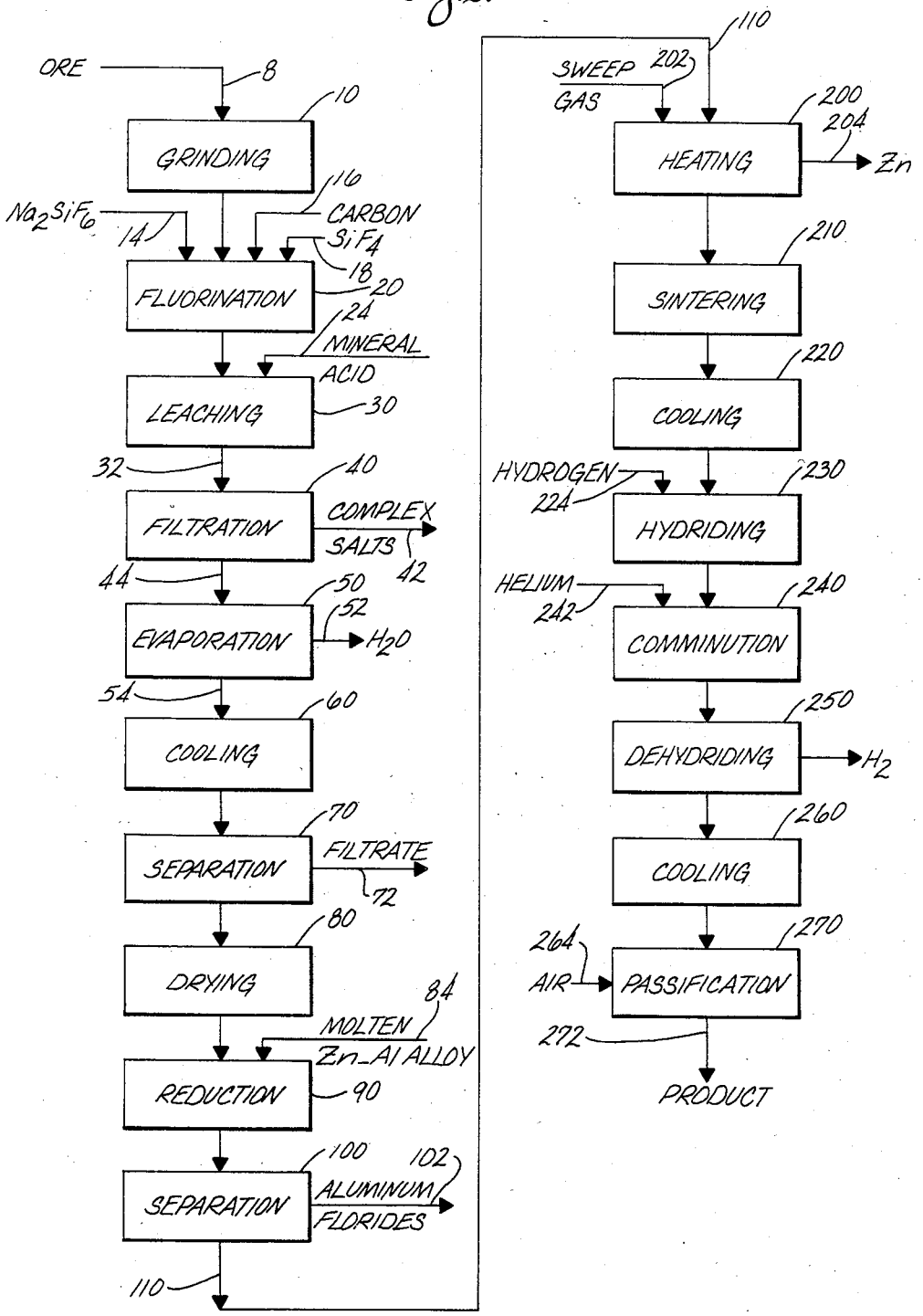
FIG. 1 is a flow sheet of one embodiment of this invention which comprises hydriding and dehydriding steps.

Referring to FIG. 1, ilmenite 8, an ore comprising titanium and iron oxides, is ground to a finely divided physical state in zone 10 to make it more susceptible to fluorination, such as between 30 and 400 mesh. The ore is fluorinated in zone 20 with a fluosilicate such as sodium fluosilicate introduced in stream 14. The mixture of sodium fluosilicate and ore is heated to a temperature of at least about 600° C. preferably from 750° to 950° C. for a time sufficient to change the iron and titanium from oxide form to fluoride form. The addition of carbon by stream 16 to the mixture has been found to have a synergistic effect on the fluorination of the ore. The reaction is carried out under an atmosphere of a gaseous fluorinating agent such as silicon tetrafluoride which can be generated in situ, or which can be introduced by stream 18. Preferably, the fluorination reaction may be carried out under a partial pressure of from about 0.1 to about 500 psig of silicon tetrafluoride. The thusly fluorinated ore is then leached in zone 30 with an aqueous solution of a strong acid such as hydrochloric or sulfuric acid introduced in stream 24. The leaching is conducted under conditions to solubilize as much of the fluorides of titanium as economically possible. Leaching may be enhanced with addition of aqueous hydrogen fluoride solution.

The mixture is passed to zone 40 in stream 32 and filtered to remove silica, residual ilmenite ore and other insoluble material in stream 42. The filtrate in stream 44 comprises soluble fluorides of titanium and as for example sodium fluotitanate. The solution may be evaporated in zone 50 to remove water in stream 52 and concentrate soluble fluorides. The concentrated solution passed to zone 60 in stream 54 and cooled to crystallize fluorides of titanium. The crystals of fluorides of titanium are separated in zone 70 from the filtrate containing soluble iron salts, dried in zone 80, and reduced in a molten state in zone 90 and a molten zinc-aluminum alloy introduced in stream 84. In one embodiment, zones 50, 60 and 70 can be all in one zone or vessel. The molten titanium fluoride salts and the zinc-aluminum alloy are essentially immiscible. Reduction is conducted at a temperature of at least about 650° C. up to about 1000° C. with agitation. After reduction is completed, agitation is ceased, and the mixture is separated in separation zone 100, into an upper phase comprising an aluminum fluoride salt which is removed in stream 102, and a lower phase comprising a titanium-zinc alloy which is removed in stream 110. The titanium-zinc alloy is substantially free of halides.

It will be understood that although a titanium-zinc alloy has been produced by the process described above, a zirconium-zinc alloy or a hafnium-zinc alloy can be produced by a similar sequence of processing steps using zirconium or hafnium ores or values.

It is desirable to have as much titanium reduced into the molten zinc alloy in zone 90 as possible to minimize the amount of zinc to be separated in the next step. The amount of titanium in the zinc can be substantially increased by operating zone 90 under a positive pressure. The titanium-zinc alloy removed in stream 110, which is substantially free of halides, is heated or distilled in zone 200 at a temperature between about 900° and 1000° C. while simultaneously introducing into zone 200 a continuous flow of hydrogen sweep gas in stream 202 under conditions effective for vaporizing and separating zinc from the alloy and to produce titanium values which are substantially free of zinc and halides. The zinc is removed via stream 204. Such titanium values are then heated in the same vessel, depicted as zone 210, to a temperature between about 1020° and about 1060° C.

under conditions operative to sinter such titanium values.

The sintered titanium values are cooled to a temperature between about 600° and about 700° C. in zone 220 and simultaneously treated, as depicted in zone 230, with hydrogen introduced in stream 224 under conditions operative to hydride and embrittle the sintered titanium values. The hydrided and embrittled titanium values are then crushed in zone 240 under an inert atmosphere, preferably helium introduced through stream 242, to form particles of titanium metal values. The particles of titanium metal values are dehydrided in zone 250 at a temperature between about 600° and about 700° C. under conditions operative to remove essentially all hydrogen values from the particles of titanium values. The dehydrided particles are cooled in zone 260 to a temperature between ambient and about 60° C. and then passified in zone 270 with a relatively small amount of air introduced in stream 264. An effective amount of air is introduced under the passification conditions to passify the particles. Excess air is not required or desirable. At least a substantial part of the passified titanium-based metal particles thusly produced and removed in stream 272 are suitable for powder metallurgy usage without further particle size reduction.

Figure 2:
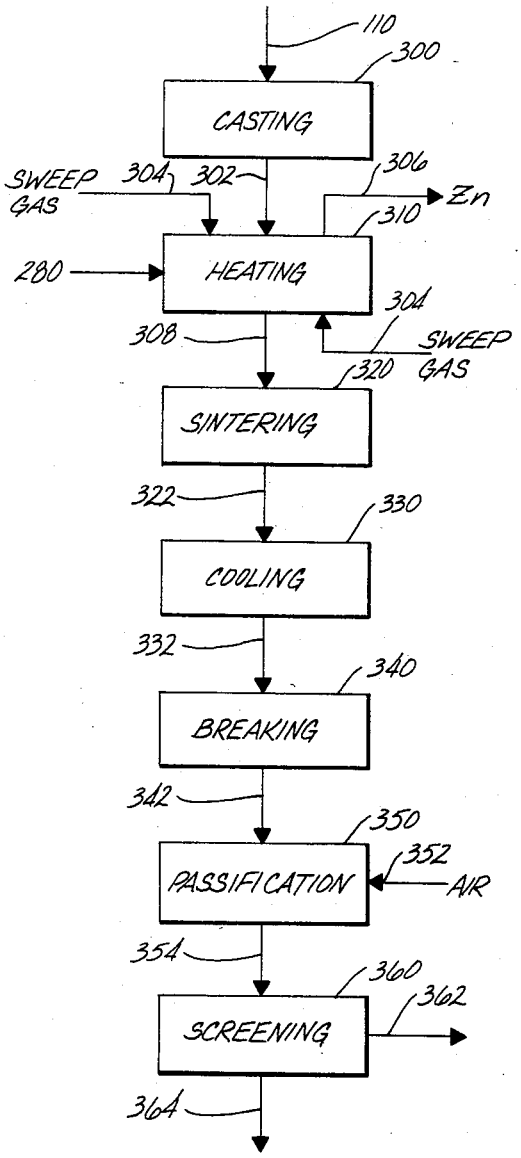
FIG. 2 is an alternate embodiment of this invention which does not require hydriding and dehydriding steps.

Referring to FIG. 2, in an alternate process, a molten stream of a titanium-zinc alloy 110, which can be prealloyed with other desirable alloying agents such as aluminum and vanadium, is introduced into casting zone 300 wherein it is formed into particles having a particle size distribution between about 60 mesh and about 20 mesh. The 60 to 20 mesh particles are removed in stream 302 and introduced into heating or distillation zone 310 along with a continuous flow of helium sweep gas introduced through stream 304. In heating zone 310, which is operated at atmosphere pressure, the zinc is vaporized from the titanium-zinc matrix and removed through stream 306. Particles of titanium values, which are substantially free of zinc and halides, are removed by stream 308 and introduced into sintering zone 320 which is maintained at a sintering temperature between about 1020° and 1060° C. to sinter the particles of titanium values. During sintering the particles of titanium values shrink but do not fuse though some weak sticking or adhering of particle-to-particle usually occurs. The sintered particle masses are removed through stream 322 and introduced into cooling zone 330 wherein they are cooled to a temperature between about ambient and about 60° C. The cooled particles are removed through stream 332 and introduced into breaking zone 340 wherein the weakly adhered particle masses are broken apart by suitable mechanical means under non-deleteriously-reactive environment. The thusly separated particles removed in stream 342 are introduced into passification zone 350 where they are passified with a relatively small amount of air introduced through stream 352. In some embodiments such breaking is not required. Passified titanium-based metal particles are removed through stream 354 and introduced into screening zone 360 wherein oversized particles are separated and removed through stream 362 and particles having desirable particle size are removed through stream 364. A substantial amount by weight of passified particles of titanium values having a desired particle size suitable for powder metallurgy usage without additional particle size reduction are removed through stream 364.

Figure 3:
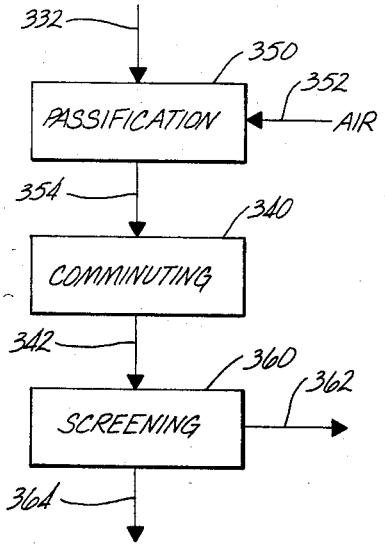
FIG. 3 is an alternative embodiment of this invention which does not require the sintering step.

An alternative embodiment of the process of FIG. 2 is shown in FIG. 3. The sintered particle masses are passed from cooling zone 330 (shown in FIG. 2) through stream 332 to passification zone 350 where they are passified with air introduced through stream 352 as described above. The passified sintered particle masses are passed from zone 350 into breaking zone 340 through stream 354 wherein the weakly adhered particle masses are broken apart by conventional mechanical means under a nondeleteriously-reactive environment as described above. The separated particles are passed from zone 340 into screening zone 360 through stream 342 wherein oversized particles are separated and removed through stream 362 and particles having the desired particle size are removed through stream 364.

Figure 4:
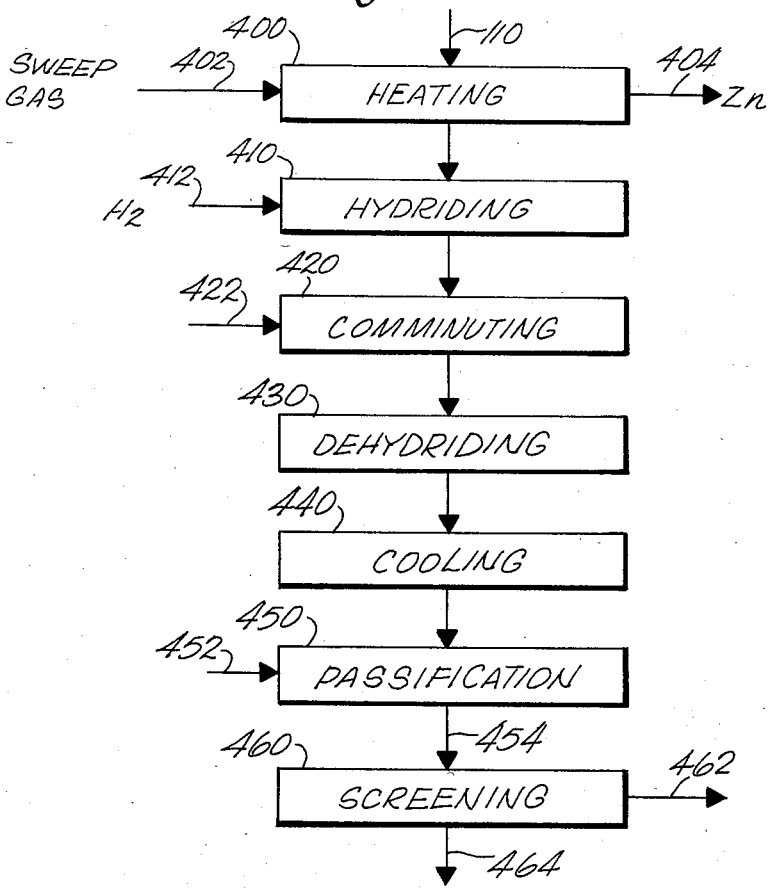
FIG. 4 is an alternative embodiment of this invention which does not require a sintering step.

Referring to FIG. 4, a titanium-zinc alloy, optionally alloyed with other alloying agents, which is substantially free of halides, is passed to heating zone 400 through stream 110 wherein the alloy is heated to distill off the zinc at a temperature between about 900°–1000° C. while simultaneously introducing into zone 400 a flow of hydrogen sweep gas from stream 402 under conditions effective for the distillation of the zinc from the alloy to produce titanium values which are substantially free of zinc and halide. The zinc is removed in stream 404. The titanium values are passed to hydriding zone 410 wherein the titanium values are treated with hydrogen introduced through stream 412 under conditions operative to hydride and embrittle the titanium values. The hydrided titanium values are comminuted in comminuting zone 420 under an inert atmosphere, such as argon or helium, introduced in stream 422 to form particles of titanium metal values. The hydrided titanium values may be comminuted with conventional equipment known to the art for crushing metal values. Such equipment may be modified for comminuting under an inert atmosphere. The particles of titanium metal values from zone 420 are passed to dehydriding zone 430 wherein the particles are heated to a temperature between about 600° –700° C. under conditions operative to remove essentially all the hydrogen values from the particles. The dehydrided particles are cooled in cooling zone 440 to a temperature between about ambient to about 60° C. and then passed to a passification zone 450 and passified with a small or effective amount of air introduced in stream 452. The passified particles of titanium values are passed to screening zone 460 wherein oversized particles are separated and removed through stream 462 and particles having the desired particle size distribution are removed through stream 464.

Figure 5:
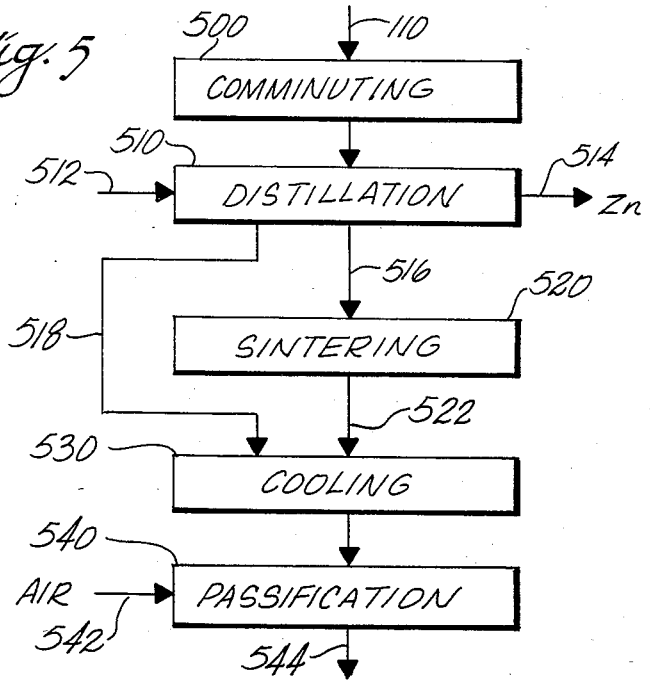
FIG. 5 is a further alternate embodiment of this invention which does not require the hydriding and dehydriding steps, and, optionally, does not require the sintering step.

Referring to FIG. 5, and an alternative process, a titanium-zinc alloy, which may be optionally alloyed with other alloying agents, is introduced into comminuting zone 500 through stream 110 wherein the alloy is crushed or ground to predetermined particle size, preferably from about 80 mesh to about ¼ inch, to form particles of the titanium-zinc alloy. Alternatively, the titanium-zinc alloy can be cast into irregular particles of a predetermined particle size in a casting zone (not shown) rather than comminuted as described herein. The titanium-zinc alloy can also be formed into particles by conventional shot forming techniques (not shown), such as the shot tower techniques. The particles are preferably deformed into irregular particles by dropping the particles on a hard surface or deforming the particles in a rod mill or ball mill. The particles are passed to a distillation zone 510, optionally a nondeleteriously-reactive sweep gas may be introduced through stream 512, wherein the zinc is vaporized from the particles of titanium-zinc alloy and the zinc is removed in stream 514. The resulting particles of titanium values, which are substantially free of zinc and halides, are introduced in a stream 516 into sintering zone 520 wherein the titanium values are then heated to a sintering temperature under conditions operative to sinter such titanium values. The sintered titanium values are introduced in stream 522 into cooling zone 530 wherein the sintered titanium values are cooled to a temperature between about ambient and about 60° C. The cooled sintered titanium values are introduced into passification zone 540 wherein titanium values are passified with an effective amount or relatively small amount of air introduced in stream 542 to produce passified titanium-based metal particles suitable for powder metallurgy usage which are removed in stream 544. In an alternative embodiment, the sintering step in zone 520 is eliminated and titanium values from distillation zone 510 are introduced into cooling zone 530 through stream 518 wherein the titanium values, substantially free of halides and zinc, are cooled to a temperature between about ambient and about 60° C. The cooled titanium values are introduced into passification zone 540 wherein the titanium values are passified with an effective amount of air introduced in stream 542 to produce passified titanium-based metal particles, substantial portions of which are suitable for powder metallurgy usage without further partifle size reduction. Such passified titanium-based metal particles may be screened in a screening zone (not shown) to separate oversized particles from the particles of the desired particle size range. When the sintering step is omitted, the passification step, is preferably controlled, to prevent excess contamination of the titanium values with nitrogen and oxygen which are introduced during passification.

Figure 6:
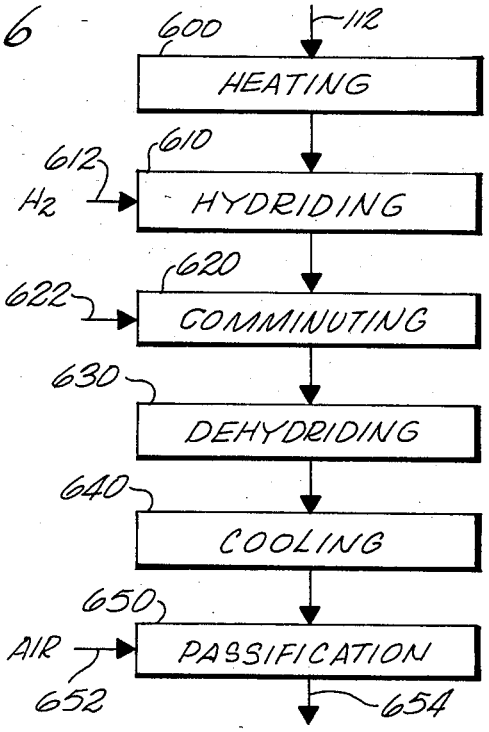
FIG. 6 is a flow sheet of one embodiment of this invention which comprises preparing a passified Group IVb transition metal-based metal powder from a passified Group IVb transition metal sponge.

Referring to FIG. 6, an alternative process is illustrated which employs sintered Group IVb transition metal sponge substantially free of halides and zinc which is produced from a Group IVb transition metal-zinc alloy substantially free of halide by distilling off the zinc to produce a Group IVb transition metal sponge substantially free of haldies and zinc, sintering the metal sponge at a temperature between about 1020°-1060° C. under conditions operative to sinter such metal values, and passifying the sintered metal sponge with an effective amount or small amount of oxygen, nitrogen or air at a temperature between about ambient and about 60° C. to produce a passified Group IVb transition metal sponge which is introduced through stream 112 into heating zone 600 to heat the sintered metal sponge to a temperature between about 600°-700° C. The heated passified metal sponge is introduced in hydriding zone 610 wherein the metal sponge is contacted with hydrogen gas introduced in stream 612 under conditions operative to hydride the heated metal sponge at a temperature between about 600° and about 700° C. Optionally, the heating step and dehydriding step in zones 600 and 610, respectively, can be carried out in the same vessel. The hydrided metal sponge is passed to comminuting zone 620 wherein the metal sponge is crushed to a desired particle size distribution using conventional metal crushing equipment known to the art. Preferably, the comminuting performed under an inert atmosphere or gas introduced in stream 622 into zone 620. The metal particles are introduced into dehydriding zone 630 wherein the metal particles are dehydrided at a temperature between about 600°-700° C. under conditions operative to remove essentially all of the hydrogen values from the metal particles. The dehydrided metal particles are cooled in cooling zone 640 and passified in passification zone 650 with an effective amount or small amount of air introduced in stream 652 as described above with respect to FIG. 5. The resulting passified Group IVb transition metal-based metal particles are recovered from stream 654. Substantial portions of the metal particles in stream 654 are suitable for powder metallurgy usage without additional particle size reduction. These particles may be screened in a screening zone (not shown) to remove the oversized particles from the particles of the desired particle size range.

It is to be understood that the foregoing detailed description is given merely as an illustrative example and that various modifications, changes, variations, and equivalent steps may be made to the invention herein described without departing from the spirit and scope of the present invention. For example, steps conducted at atmospheric pressure may in some circumstances be beneficially conducted at slightly higher or lower pressure than atmospheric and hence, by atmospheric we mean to include such slight pressure variations. Other elements are to be construed similarly. Furthermore, even though the detailed description has illustrated operation of the invention with titanium values, the invention is equally operative with other Group IVb transition metal values, such as zirconium and hafnium values.

What is claimed is:

1. A powder metal comprising a Group IVb transition metal useful for powdered metallurgical applications characterized as having less than about 50/ppm by weight halide, an internal porosity of from about 10% to about 30% by volume, and the powder comprising angular shaped particles.

2. The powder metal of claim 1 wherein the transition metal is selected from the group consisting of titanium, hafnium and zirconium.

3. The powdered metal of claim 2 wherein the metal is titanium.

4. The powder metal of claim 3 wherein the metal is alloyed, by weight percent, with a least one of the following alloying agents: 0 to about 5% tin, 0 to about 10% vanadium, 0 to about 10% aluminum, 0 to about 5% zirconium, 0 to 5% molybdenum, 0 to about 10% silicon, 0 to about 10% iron, 0 to about 0.5% oxygen and mixtures thereof, the metal comprising at least 90% by weight titanium.

5. The powdered metal of claim 2 wherein the Group IVb transition metal is selected from the group consisting of hafnium and zirconium.

6. The powdered metal of claim 5 wherein the metal is alloyed, by weight percent, with at least one of the following alloying agents: 0 to about 3% tin, 0 to about 0.40% iron, 0 to about 0.02% chromium, 0 to about 0.01% nickel, 0 to about 10% niobium, 0 to about 0.5% oxygen and mixtures thereof; the metal comprising at least 90% by weight hafnium or zirconium.

7. The powder metal of claim 1 wherein the metal has less than about 10 PPM by weight halide and the powder has an internal porosity of about 10% to about 20%.

8. The powder metal of claim 1 wherein the metal has less than about 2500 PPM by weight oxygen, less than about weight n and less than about 400 PPM by weight nitrogen and less than about 800 PPM by weight carbon.

9. The powder metal of claim 1 wherein the metal has less than about 50 PPM by weight oxygen, less than about 90 PPM by weight nitrogen, and less than about 150 PPM by weight carbon.

10. The powder metal of claim 9 wherein the metal has less than about 10 PPM by weight halide.

11. Passified Group IVb transition metal-based metal particles which are substantially free of halides, hydrogen, oxygen, nitrogen and carbon, and which are suitable for powder metallurgy usage, prepared from a Group IVb transition metal-zinc alloy by:

(a) heating a Group IVb transition metal-zinc alloy, which is substantially free of halides, at a temperature between about 500° and about 1150° C. under conditions operative to vaporize and separate zinc therefrom and to produce Group IVb transition metal values which are substantially free of zinc and halide;

(b) heating said transition metal values to, or maintaining said transition metal values at, a sintering temperature between about 850° and about 1250° C. under conditions operative to sinter said transition metal values;

(c) cooling said sintered transition metal values to a lower temperature between about 300° and about 700° C., and simultaneously contacting said sintered transition metal values with hydrogen under conditions operative to hydride and embrittle said sintered transition metal values, thereby forming embrittled transition metal values;

(d) comminuting said embrittled transition metal values under a nondeleteriously-reactive atmosphere, to a predetermined particle size distribution, such that at least a substantial amount by weight of said particles are suitable for powder metallurgy usage without further particle size reduction, thereby forming particles of transition metal values;

(e) dehydriding said particles of transition metal values at a temperature between about 400° and about 700° C. under conditions operative to remove essentially all hydrogen values from said particles of transition metal values and to produce dehydrided particles of transition metal values; and (f) contacting said dehydrided particles with a small amount of a gas selected from the group consisting of oxygen, nitrogen, and mixtures thereof under conditions operative to passify said dehydrided particles thereby producing passified Group IVb transition metal-based metal particles which are substantially free of halides, hydrogen, oxygen, nitrogen and carbon.

12. The metal particles of claim 11 wherein said Group IVb transition metal-zinc alloy is a titanium-zinc alloy.

13. The metal particles of claim 11 wherein said Group IVb transistion metal-zinc alloy and zirconium-zinc alloy.

14. Passified Group IVb transition metal-based metal particles substantially free of halides, zinc, hydrogen, oxygen, nitrogen and carbon, and suitable for powder metallurgy usage, which are produced from a transition metal-zinc alloy by a process comprising:

(a) forming a Group IVb transition metal-zinc alloy, which is substantially free of halides, hydrogen, oxygen, nitrogen and carbon, into particles, at least 90% by weight of said particles having a particle size distribution between 80 mesh and about ¼ inch;

(b) heating said particles in a zone maintained at a temperature between about 500° and about 1150° C. under conditions operative to vaporize and separate zinc from said transition metal-zinc alloy particles and to produce particles of Group IVb transition metal values which are substantially free of halides, zinc, hydrogen, oxygen, nitrogen and carbon;

(c) heating said particles to a sintering temperature between about 850° and 1250° C. under conditions operative to sinter said particles;

(d) cooling said sintered particles to a lower temperature between about ambient temperature and about 200° C.;

(e) contacting said cooled sintered particles with a small amount of a gas selected from the group consisting of oxygen, nitrogen, and mixtures thereof under conditions operative to passify said cooled sintered particles thereby producing passified Group IVb transition metal-based metal particles which are substantially free of halides, zinc, hydrogen, oxygen, nitrogen and carbon; and (f) said forming of a Group IVb transition metal-zinc alloy of a specified particle size distribution in step (a), and said heating of said first particles in step (c) being operative to cause said passified Group IVb transition metal-based metal particles produced in step (e) to have a particle size distribution such that a significant amount by weight of said passified Group IVb transition metal-based metal particles are suitable for powder metallurgy usage without additional particle size reduction.

15. The metal particles of claim 14 wherein said Group IVb transition metal-zinc alloy is a titanium-zinc alloy.

16. The metal particles of claim 14 wherein said Group IVb transition metal-zinc alloy particles formed in step (a) has a particle size distribution of about 90% by weight between about 60 mesh and about 20 mesh.

17. The metal particles of claim 14 wherein said forming of a Group IVb transition metal-zinc alloy into particles in step (a) comprises comminuting of said alloy.

18. The metal particles of claim 14 wherein said forming of a Group IVb transition metal-zinc alloy into particles in step (a) comprises casting said alloy.

19. The metal particles of claim 14 wherein said Group IVb transition metal-zinc alloy is selected from the group consisting of hafnium-zinc alloy and zirconium-zinc alloy.

20. A process to produce passified Group IVb transition metal-based metal particles which are substantially free of halides, and which are suitable for powder metallurgy usage, from a Group IVb transition metal-zinc alloy comprising:

(a) heating a Group IVb transition metal-zinc alloy, which is substantially free of halides, in a distillation zone maintained at a temperature between about 500° and about 1150° C. under conditions operative to vaporize and separate zinc from said transition metal-zinc alloy and to produce Group IVb transition metal values which are substantially free of zinc and halides;

(b) cooling said sintered transition metal values to a lower temperature between about 300° and about 700° C., and simultaneously contacting said sintered transition metal values with hydrogen under conditions operative to hydride and embrittle said transition metal values, thereby forming embrittled transition metal values;

(c) comminuting said embrittled transition metal values under a nondeleteriously-reactive atmosphere, to a predetermined particle size distribution of about 90% by weight between about 80 mesh and about ¼ inch thereby forming particles of transition metal values;

(d) dehydriding said particles of transition metal values at a temperature between about 400° and 700° C. under conditions operative to remove essentially all hydrogen values from said particles of transition metal values and to produce dehydrided particles of transition metal values; and (e) contacting said dehydrided particles with an effective amount of a gas selected from the group consisting of oxygen, nitrogen, and mixtures thereof under conditions operative to passify said dehydrided particles thereby producing passified Group IVb transition metal-based metal particles which are substantially free of halides.

21. The process of claim 20 wherein said heating step (a) is conducted under a partial vacuum.

22. The process of claim 20 wherein said heating step (a) is conducted under a continuous flow of a nondeleteriously-reactive sweep gas.

23. The process of claim 22 wherein said nondeleteriously-reactive sweep gas is selected from the group consisting of hydrogen, an inert gas, and mixtures thereof.

24. The process of claim 20 wherein said dehydriding step (d) is conducted under a partial vacuum.

25. The process of claim 20 wherein the entire process is conducted at temperatures which are no higher than about 1300° C.

26. The process of claim 20 wherein the entire process is conducted at temperatures which are no higher than about 1150° C.

27. The process of claim 20 wherein said Group IVb transition metal-zinc alloy is produced from Group IVb transition metal sponge and zinc.

28. The process of claim 20 wherein said Group IVb transition metal-zinc alloy is produced from the reduction of a transition metal halide with a metal alloy which comprises a reductant metal and zinc.

29. The metal particles of claim 20 wherein said Group IVb transition metal-zinc alloy is a titanium-zinc alloy.

30. The metal particles of claim 20 wherein said Group IVb transition metal-zinc alloy is selected from the group consisting of hafnium-zinc alloy and zirconium-zinc alloy.

31. A process to produce passified Group IVb transition metal-based metal particles which are substantially free of halides, and which are suitable for powder metallurgy usage, from a Group IVb transition metal-zinc alloy comprising:

(a) forming a Group IVb transition metal-zinc alloy, which is substantially free of halides, into irregular shaped particles, at least 90% by weight of said particles having a particle size distribution between about 80 mesh and about ¼ inch;

(b) heating said Group IVb transition metal-zinc alloy particles in a zone maintained at a temperature between about 500° and about 1150° C., under conditions operative to vaporize and separate zinc from said transition metal-zinc alloy particles to produce particles of Group IVb transition metal-based metal which are substantially free of zinc and halides;

(c) cooling said Group IVb transition metal based-metal value particles to a temperature below about 200° C.;

(d) contacting said cooled Group IVb transition metal based-metal particles with a small amount of a gas selected from the group consisting of oxygen, nitrogen, and mixtures thereof under conditions operative to passify said particles thereby producing passified Group IVb transition metal-based metal particles which are substantially free of halides; and (e) said forming of a Group IVb transition metal-zinc alloy of a specified particles size distribution in step (a), and said heating of said first particles in step (b) being operative to cause said passified transition metal-based metal particles produced in step (d) to have a particle size distribution such that a significant amount by weight of said passified transition metal-based metal particles are suitable for powder metallurgy usage without additional particle size reduction.

32. The process of claim 31 wherein the particles of Group IVb transition metal-based metal produced in heating step (b) are heated to, or maintained at, a sintering temperature between about 850° and 1250° C. under conditions operative to sinter said particles in a sintering zone to produce sintered particles of Group IVb transition metal-based metal prior to cooling said particles in cooling step (c).

33. The process of claim 31 wherein said heating step (b) is conducted under a partial vacuum.

34. The process of claim 31 wherein said heating step (b) is conducted under a continuous flow of a nondeleteriously-reactive sweep gas.

35. The process of claim 34 wherein said nondeleteriously-reactive sweep gas is selected from the group consisting of hydrogen, an inert gas, and mixtures thereof.

36. The process of claim 31 wherein the entire process is conducted at temperatures which are no higher than about 1150° C.

37. The process of claim 31 wherein said Group IVb transition metal-zinc alloy is produced from Group IVb transition metal sponge and zinc.

38. The process of claim 31 wherein said Group IVb transition metal-zinc alloy is produced from the reduction of a transition metal halide with a metal alloy which comprises a reductant metal and zinc.

39. The process of claim 31 wherein said Group IVb transition metal-zinc alloy is a titanium-zinc alloy.

40. The process of claim 31 wherein said Group IVb transition metal-zinc alloy is selected from the group consisting of hafnium-zinc alloy and zirconium-zinc alloy.

41. A process to produce passified Group IVb transition metal-based metal particles which are substantially free of halides, and which are suitable for powder metallurgy usage, from passified Group IVb transition metal based-metal sponge, substantially free of zinc and halides, comprising:

(a) heating a passified Group IVb transition metal based-metal sponge, which is substantially free of zinc and halides, at a temperature between about 300° and about 700° C.;

(b) contacting said heated passified Group IVb transition metal based-metal sponge with hydrogen under conditions operative to hydride and embrittle said transition metal based-metal, thereby forming embrittled Group IVb transition metal values;

(c) comminuting said embrittled Group IVb transition metal values under a nondeleteriously-reactive atmosphere, to a predetermined particle size distribution thereby forming particles of hydrided Group IVb transition metal values;

(d) dehydriding said particles of hydrided Group IVb transition metal values at a temperature between about 400° and about 700° C. under conditions operative to remove essentially all hydrogen values from said particles of Group IVb transition metal values and to produce dehydrided particles of Group IVb transition metal values;

(e) contacting said dehydrided particles of Group IVb transition metal values with a small amount of a gas selected from the group consisting of oxygen, nitrogen, and mixtures thereof under conditions operative to passify said dehydrided particles thereby producing passified Group IVb transition metal-based metal particles which are substantially free of halides; and (f) said comminuting of said embrittled transition metal values to predetermined particle size distribution in step (c) being operative to cause said passified transition metal-based metal particles produced in step (e) to have a particle size distribution such that a significant amount by weight of said passified Group IVb transition metal-based metal particles are suitable for powder metallurgy usage without additional particle size reduction.

42. The process of claim 41 wherein said nondeleteriously-reactive atmosphere used in step (c) is an inert gas.

43. The process of claim 41 wherein said heating step (a) is conducted under a nondeleteriously-reactive sweep gas.

44. The process of claim 41 wherein said dehydriding in step (e) is conducted under a partial vacuum.

45. The process of claim 41 wherein the entire process is conducted at temperatures which are no higher than about 1150° C.

46. The process of claim 41 wherein the Group IVb transition metal of the passified Group IVb transition metal-based metal, substantially free of zinc and halides, is selected from titanium, hafnium and zirconium.

47. A metal sponge comprising a Group IVb transition metal useful for metallurgical applications characterized as having less than about 50 PPM by weight halide and an internal porosity of from about 10% to about 30% by volume.

48. The metal sponge of claim 47 wherein the transition metal is selected from the group consisting of titanium, hafnium and zirconium.

49. The metal sponge of claim 48 wherein the metal is titanium.

50. The metal sponge of claim 49 wherein the metal is alloyed, by weight percent, with at least one of the following alloying agents: 0 to about 5% tin, 0 to about 10% vanadium, 0 to about 10% aluminum, 0 to about 5% zirconium, 0 to 5% molybdenum, 0 to about 10% silicon, 0 to about 10% iron, 0 to about 0.5% oxygen and mixtures thereof, the metal comprising at least 90% by weight titanium.

51. The powdered metal of claim 48 wherein the Group IVb transition metal is selected from the group consisting of hafnium and zirconium.

52. The powdered metal of claim 51 wherein the metal is alloyed, by weight percent, with at least one of the following alloying agents: 0 to about 3% tin, 0 to about 0.04 iron, 0 to about 0.2% chromium, 0 to about 0.01% nickel, 0 to about 10% niobium, 0 to about 0.5% oxygen and mixtures thereof; the metal comprising at least 90% by weight hafnium or zirconium.

53. The metal sponge of claim 47 wherein the metal has less than about 10 PPM by weight halide and an internal porosity of about 10% to about 20%.

54. The metal sponge of claim 47 wherein the metal has less than about 2500 PPM by weight oxygen, less than about 400 PPM by weight nitrogen and less than about 800 PPM by weight carbon.

55. The metal sponge of claim 47 wherein the metal has less than about 50 PPM by weight oxygen, less than about 90 PPM by weight nitrogen, and less than about 150 PPM by weight carbon.

56. The metal sponge of claim 55 wherein the metal has less than about 10 PPM by weight halide.

57. A powder metal useful for powder metallurgical applications characterized as having angular shaped particles with an internal porosity of from about 10% to about 30% by volume, less than about 10 PPM by weight halide, less than about 50 PPM by weight oxygen, less than about 90 PPM by weight nitrogen, less than about 150 PPM by weight carbon, said powder metal comprising at least 90% by weight titanium and, by weight percent,:

0–5% tin,
0–10% vanadium,
0–10% aluminum,
0–5% zirconium,
0–5% molybdenum,
0–10% silicon,
0–10% iron, and
0–0.5% oxygen.

58. A metal sponge useful for powder metallurgical applications characterized as having an internal porosity of from about 10% to about 30% by volume, less than about 10 PPM by weight halide, less than about 50 PPM by weight oxygen, less than about 90 PPM by weight nitrogen, less than about 150 PPM by weight carbon, said metal sponge comprising at least 90% by weight titanium and, by weight percent, 0–5% tin,
0–10% vanadium,
0–10% aluminum,
0–5% zirconium,
0–5% molybdenum,
0–10% silicon,
0–10% iron, and
0–0.5% oxygen.

59. A process to produce passified Group IVb transition metal-based metal particles which are substantially free of halides, and which are suitable for powder metallurgical usage, from a Group IVb transition metal-zinc alloy comprising:

(a) heating a Group IVb transition metal-zinc alloy, which is substantially free of halides to a temperature between about 900° and about 950° C. under conditions operative to vaporize and separate zinc therefrom to produce Group IVb transition metal values which are substantially free of zinc and halides;

(b) comminuting said transition metal values under a nondeleteriously-reactive atmosphere to a predetermined particle size distribution of from +200 to −30 mesh thereby forming particles of transition metal values; and (c) contacting said particles with an effective amount of a gas selected from the group consisting of oxygen, nitrogen and mixtures thereof under conditions operative to passify said particles thereby producing passified Group IVb transition metal-based particles which are substantially free of halides.

60. A process to produce passified titanium metal-based metal particles comprising titanium which are substantially free of halides and which are suitable for powder metallurgy usage from a titanium zinc alloy comprising:

(a) forming an alloy comprising titanium and zinc, which is substantially free of halides, into irregular shaped particles, at least 90% by weight of said particles having a particle size distribution between about 60 mesh and about 20 mesh;

(b) heating said alloyed particles in a zone maintained at a temperature of between about 900° and about 950° C., under conditions operative to vaporize and separate zinc from said particles to produce particles of titanium metal based metal substantially free of zinc and halides;

(c) cooling said particles to a temperature between ambient and about 60° C.;

(d) contacting said cooled titanium particles with a small amount of a gas selected from the group consisting of oxygen, nitrogen and mixtures thereof under conditions operative to passify said particles thereby producing passified titanium metal-based metal particles; and (e) said forming of titanium-zinc alloy particles of a specified particle size distribution in step (a), and said heating of said particles in step (b) being operative to cause passified titanium metal-based metal particles produced in step (d) to have a particle size distribution such that significant amount by weight of said passified titanium metal-based metal particles are suitable for powder metallurgy usage without additional particle size reduction.

61. A process to produce passified Group IVb transition metal-based metal particles substantially free of halides, zinc, hydrogen, oxygen, nitrogen and carbon, and suitable for powder metallurgy usage, from a Group IVb transition metal-zinc alloy comprising:

(a) forming a Group IVb transition metal-zinc alloy, which is substantially free of halides, hydrogen, oxygen, nitrogen and carbon, into particles, at least 90% by weight of said particles having a particle size distribution between 80 mesh and about ¼ inch;

(b) heating said particles in a zone maintained at a temperature between about 500° and about 1150° C. under conditions operative to vaporize and separate zinc from said transition metal-zinc alloy particles and to produce particles of Group IVb transition metal values which are substantially free of halides, zinc, hydrogen, oxygen, nitrogen and carbon;

(c) heating said particles to a sintering temperature between about 850° and 1250° C. under conditions operative to sinter said particles;

(d) cooling said sintered particles to a lower temperature between about ambient temperature and about 200° C.;

(e) contacting said cooled sintered particles with a small amount of a gas selected from the group consisting of oxygen, nitrogen, and mixtures thereof under conditions operative to passify said cooled sintered particles thereby producing passified Group IVb transition metal-based metal particles which are substantially free of halides, zinc, hydrogen, oxygen, nitrogen and carbon; and (f) said forming of a Group IVb transition metal-zinc alloy of a specified particle size distribution in step (a), and said heating of said particles in step (c) being operative to cause said passified Group IVb transition metal-based metal particles produced in step (e) to have a particle size distribution such that a significant amount by weight of said passified Group IVb transition metal-based metal particles are suitable for powder metallurgy usage without additional particle size reduction.

62. The process of claim 61 wherein said heating step (b) is conducted under a partial vacuum.

63. The process of claim 61 wherein said heating step (b) is conducted under a continuous flow of a non-deleteriously-reactive sweep gas.

64. The process of claim 63 wherein said non-deleteriously-reactive sweep gas is selected from the group consisting of hydrogen, an inert gas, and mixtures thereof.

65. The process of claim 61 wherein said Group IVb transition metal-zinc alloy is a titanium-zinc alloy.

66. The process of claim 61 wherein said Group IVb transition metal-zinc alloy is selected from the group consisting of hafnium-zinc alloy and zirconium-zinc alloy.

67. The process of claim 61 wherein said forming of a Group IVb transition metal-zinc alloy into particles in step (a) comprises comminuting of said alloy.

68. The metal particles of claim 61 wherein said forming of a Group IVb transition metal-zinc alloy into particles in step (a) comprises casting said alloy.

69. A process to produce titanium metal-based metal particles substantially free of halides, zinc, hydrogen, oxygen, nitrogen and carbon and suitable for powder metallurgy usage, from a titanium metal-zinc alloy comprising:

(a) forming a titanium metal-zinc alloy, which is substantially free of halides, hydrogen, oxygen, nitrogen and carbon, into particles, at least 90% by weight of the particles having a particle size distribution between about 60 mesh and about 20 mesh;

(b) heating said particles in a zone maintained at a temperature between about 900° and 950° C. under conditions operative to vaporize and separate zinc from said titanium metal-zinc alloyed particles to produce particles of titanium metal-based metal which are substantially free of halides, zinc, hydrogen, oxygen, nitrogen and carbon;

(c) heating said particles to a sintering temperature of between about 1020° and 1060° C. under conditions operative to sinter said particles;

(d) cooling said sintered particles to a lower temperature between about ambient temperature and about 60° C.;

(e) contacting said cooled sintered particles with a small amount of gas selected from the group consisting of oxygen, nitrogen, and mixtures thereof under conditions operative to passify said particles thereby producing passified titanium metal-based metal particles which are substantially free of halides, zinc, hydrogen, oxygen, nitrogen and carbon; and (f) said forming of titanium metal-zinc alloy of a specified particle size distribution in step (a), and said heating of said titanium metal based metal particles in step (c) being operative to cause said passified titanium metal-based metal particles produced in step (e) to have a particle size distribution such that a significant amount by weight of said passified titanium metal-based metal particles are suitable for powder metallurgy usage without additional particle size reduction.

70. A process to produce titanium metal-based metal particles which are substantially free of halides, zinc, hydrogen, oxygen, nitrogen and carbon, and suitable for powder metallurgy usage, from a titanium metal-zinc alloy comprising:

(a) heating a titanium metal-zinc alloy, which is substantially free of halides, hydrogen, oxygen, nitrogen and carbon to a temperature between about 900° and 950° C. under conditions operative to vaporize and separate zinc therefrom to produce titanium metal-based metal which is substantially free of halides, zinc, hydrogen, oxygen, nitrogen and carbon;

(b) comminuting said titanium metal-based metal under a nondeleteriously-reactive atmosphere to a predetermined particle size distribution of from +200 to −30 mesh thereby forming particles of titanium metal-based metal; and (c) contacting said titanium metal-based metal particles with an effective amount of a gas selected from the group consisting of oxygen, nitrogen and mixtures thereof under conditions operative to passify said particles thereby producing passified titanium metal-based metal particles which are substantially free of halides, zinc, hydrogen, oxygen, nitrogen and carbon.

* * * * *